United States Patent [19]

Kato et al.

[11] Patent Number: 4,540,968

[45] Date of Patent: Sep. 10, 1985

[54] OPEN FUSE CUTOUT

[75] Inventors: Kazuaki Kato, Chita; Tomio Washizu, Ichinomiya, both of Japan

[73] Assignees: NGK Insulators, Ltd., Nagoya; Takamatsu Electric Works, Ltd., Inuyama, both of Japan

[21] Appl. No.: 605,942

[22] Filed: May 1, 1984

[30] Foreign Application Priority Data

May 7, 1983 [JP] Japan ..... 58-68175[U]

[51] Int. Cl.[3] ..... H01H 71/10

[52] U.S. Cl. ..... 337/31; 337/1; 337/168; 361/132

[58] Field of Search ..... 337/1, 4, 28, 31, 32, 337/167, 168; 361/38, 39, 131, 132

[56] References Cited

U.S. PATENT DOCUMENTS

| | | | |
|---|---|---|---|
| 1,939,371 | 12/1933 | Spurgeon | 337/31 |
| 2,490,952 | 12/1949 | Earle | 337/31 |
| 2,648,796 | 8/1953 | Manke | 337/32 |
| 2,971,132 | 2/1961 | Nash | 337/32 |

*Primary Examiner*—Harold Broome

*Attorney, Agent, or Firm*—Jordan and Hamburg

[57] ABSTRACT

An open fuse cutout has a built-in lightning arrester. The open fuse cutout includes a supporting insulator with a protective cap fixed to an upper end thereof and containing the lightning arrester disposed laterally or vertically. The lightning arrester element has a charging electrode confronting an upper electrode across a first spark gap and a grounding electrode confronting a grounding member across a second spark gap.

7 Claims, 5 Drawing Figures

OPEN FUSE CUTOUT

BACKGROUND OF THE INVENTION

1. Field of the Invention:

The present invention relates to an open fuse cutout with a built-in lightning arrester.

2. Description of the Prior Art

Open fuse cutouts are made in such a manner that exposed live portions allow a bird or an animal on an arm or the like to cause a ground-fault. To avoid such a ground-fault accident, an electrode on the top of a supporting insulator is covered with an insulating protective cap. A lightning arrester for protecting the open fuse cutout from a lightning stroke has conventionally been provided as being separate from the open fuse cutout. When the open fuse cutout is to be installed on a pole, it is necessary to reserve a space for attachment of the lightning arrester, and it is tedious and time-consuming to mount the open fuse cutout. Another problem is that the lightning arrester as installed results in a poor appearance of the assembly on the pole.

SUMMARY OF THE INVENTION

It is an object of the present invention to provide an open fuse cutout which will protect itself from a lightning surge to prevent any unwanted accident which would otherwise result from such a lightning surge.

Another object of the present invention is to provide an open fuse cutout composed of a conventional supporting insulator and a lightning arrester element that can easily be mounted on the supporting insulator.

Still another object of the present invention is to provide an open fuse cutout including a lightning arrester element which can be mounted in position without impairing the ability of a bird-proof protective cap and the appearance of the open fuse cutout as installed in place.

A still further object of the present invention is to provide an open fuse cutout having a protective cap with a built-in lightning arrester element and which can easily be molded to shape.

According to the present invention, an open fuse cutout is provided comprising a mounting member, a suporting insulator supported on the mounting member, first and second electrodes mounted on the supporting insulator, a fuse tube extending between and supported on the upper and lower electrodes, a protective cap fixed to an end of the supporting insulator, a grounding member attached to the mounting member, a lightning arrester element disposed in the protective cap and having a charging electrode and a grounding electrode, the charging electrode and the upper electrode forming a first confronting pair and the grounding electrode and the grounding member forming a second confronting pair, at least one of the first and second confronting pairs having a spark gap.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
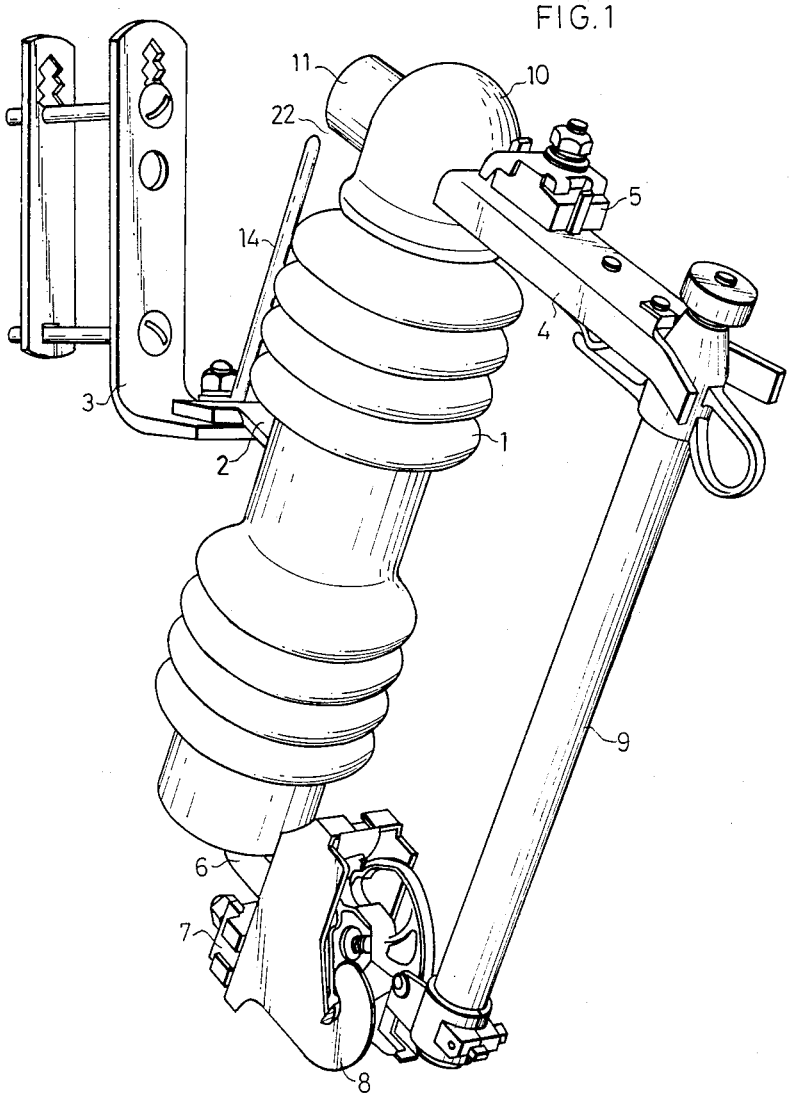
FIG. 1 is a perspective view of an open fuse cutout according to an embodiment of the present invention which embodies the principles of the invention.
Figure 2:
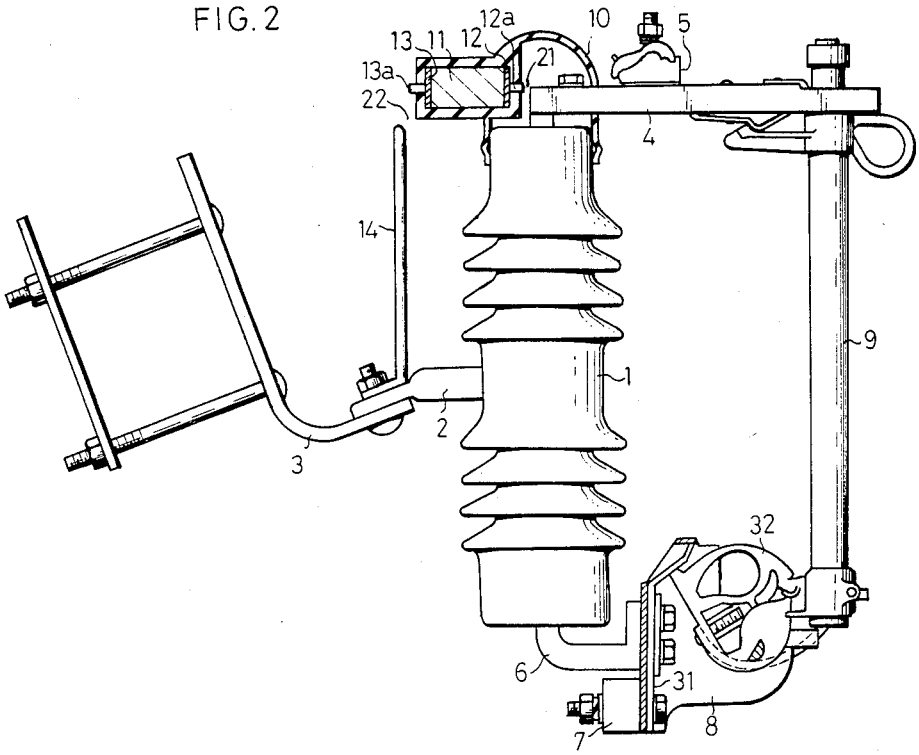
FIG 2 is a front elevational view of the open fuse cutout of FIG. 1, with a protective cap and a holder shown in cross section.

As shown in FIGS. 1 and 2, an open fuse cutout according to an embodiment of the present invention includes a supporting insulator 1 supported by a mounting member 2 on a bracket 3 attached to a pole (not shown). A first electrode 4 projects laterally from an upper end of the supporting insulator 1 and has a connector terminal 5 for connection to a power supply. A second electrode 6 projects laterally from a lower end of the supporting insulator 1 and supports a holder 8 secured thereto and having a connector terminal 7 for connection to a load. A fuse tube 9 which contains a fuse (not shown) therein has a lower end supported on the holder 8 for lateral angular displacement. The second electrode 6 and the connector terminal 7 are electrically connected to the lower end of the fuse through a conductive plate 31 and a toggle member 32 made of a conductive material. The fuse tube 9 has an upper end detachably supported by a distal end of the first electrode 4.

On the upper end of the supporting insulator 1, there is mounted a bird-proof protective cap 10 molded of an insulating material such as synthetic resin for protecting the open fuse cutout against the ground-fault by birds or other animals. The protective cap 10 is of an integrally molded construction having an upper semispherical end. A lightning arrester element 11 is laterally embedded in one side of the protective cap 10, the lightning element 11 comprising a non-linear resistor made primarily of sintered zinc oxide (ZnO) and having good non-follow-current characteristics.

A charging electrode 12 is electrically connected as by brazing to one end of the lightning arrester element 11 and has a discharger 12*a* projecting into the upper hemispherical end of the protective cap 10 in confronting relation to an end of the first electrode 4 with a spark gap 21 left therebetween. A grounding electrode 13 is electrically connected as by brazing to the other end of the lightning arrester element 11 and has a discharger 13*a* exposed out of the protective cap 10. A grounding member 14 has a proximal end fixed to the mounting member 2 and a distal end extending into a confronting relation to the discharger 13*a* of the grounding electrode 13 with a spark gap 22 left therebetween.

The open fuse cutout thus formed will operate as follows: in the position shown in FIGS. 1 and 2, a circuit is completed from the connector terminal 5 to the first electrode 4 to the fuse (not illustrated) to the holder 8 to the connector terminal 7. The circuit can be broken by angularly moving the fuse tube 9 laterally about the holder 8 from the illustrated position to bring the upper end of the fuse tube 9 out of engagement with the first electrode 4.

When an abnormal voltage such as a lightning surge is applied to the open fuse cutout, flash over occurs through the two spark gaps 21, 22 and a current is discharged from the first electrode 4 via the spark gaps 21, 22. Therefore, any distributor devices connected to the open fuse cutout and load will not be damaged by the lightning surge, and the bird-proof capability of the protective cap 10 will not be impaired.

When the lightning arrester element 11 is to be attached to the supporting insulator 1, the protective cap 10 with the lightning arrester element 11 integrally embedded therein may be fitted over the upper end of the supporting insulator 1. Therefore, the lightning arrester element 11 can be mounted on the open fuse cutout with utmost ease. There is no need for any modification of the configuration of the supporting insulator 1 for the mounting of the lightning arrester element 11, and the supporting insulator 1 of the conventional design may be used.

Figure 4:
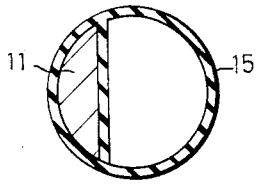
FIG. 4 is a transverse cross-sectional view of a lightning arrester element in the open fuse cutout illustrated in FIG. 3.
Figure 3:
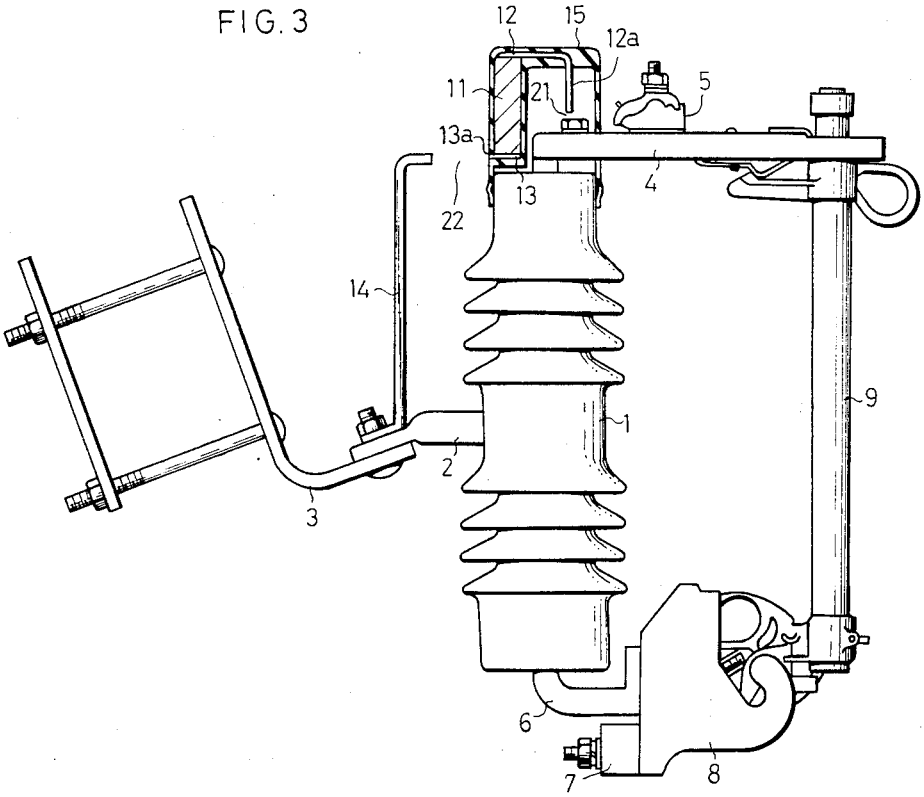
FIG. 3 is a front elevational view of an open fuse cutout according to another embodiment of the present invention, the view showing a protecting cap in cross section.

FIGS. 3 and 4 show a modification according to the present invention, which differs from the open fuse cutout illustrated in FIGS. 1 and 2 in that a protective cap 15 is in the form of a roofed cylinder including a vertically embedded lightning arrester element 11 therein. The lightning arrester element 11 is disposed along an inner side surface of the protective cap 15 and has a substantially semicylindrical configuration as shown in FIG. 4. A charging electrode 12 has a discharger **12*a* extending from an upper end of the lightning arrester element 11 to a position in the vicinity of a first electrode 4. A grounding electrode 13 has a discharger 13*a* extending from the lower end of the lightning arrester element 11 and exposed out of the protective cap 15**.

Figure 5:
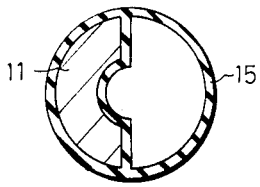
FIG. 5 is a transverse cross-sectional view of a lightning arrester element according to still another embodiment of the present invention.

Since the embedded lightning arrester element 11 does not project laterally out of the protective cap 15, the protective cap 15 can be molded more easily than the protective cap 10 of FIGS. 1 and 2. As illustrated in FIG. 5, a lightning arrester element 11 may be of a hollow, substantially semicylindrical shape with a central recessed portion for fitting engagement with the first electrode.

The charging electrode 12 and the upper electrode 4, or the grounding electrode 13 and the grounding member 14 may be kept in mutual abutment to eliminate one of the spark gaps 21, 22 while leaving the other spark gap in the foregoing embodiments.

With the arrangement of the present invention, as described above, the lightning arrester element can be mounted in position simply by fixing the protective cap, and installed without impairing the bird-proof capability of the protective cap and the appearance of the open fuse cutout as mounted. The lightning arrester element can also be mounted without modifying the configuration of the supporting insulator. The lightning arrester can protect the open fuse cutout from lightning surges to prevent any unwanted accidents which would otherwise result from such lightning surges.

Although certain preferred embodiments have been shown and described, it should be understood that many changes and modifications may be made therein without departing from the scope of the appended claims.

What is claimed is:

1. An open fuse cutout comprising:

(a) a mounting member;

(b) a supporting insulator supported on said mounting member;

(c) first and second electrodes mounted on said supporting insulator;

(d) a fuse tube extending between and supported on said first and second electrodes;

(e) a protective cap fixed to an end of said supporting insulator;

(f) a grounding member attached to said mounting member;

(g) a lightning arrester element disposed in said protective cap and defining a first charging electrode and a grounding electrode, said charging electrode and said first electrode forming a first confronting pair and said grounding electrode and said grounding member forming a second confronting pair; and (h) at least one of said first and second confronting pairs having a spark gap.

2. An open fuse cutout according to claim 1, wherein said protective cap has a substantially hemispherical configuration covering said charging electrode and a portion of said first electrode confronting the charging electrode, said lightning arrester element extending laterally with the grounding electrode thereof projecting laterally from said supporting insulator.

3. An open fuse cutout according to claim 2, wherein said charging electrode includes a discharger disposed in confronting relation to said first electrode across said first spark gap, said grounding electrode including a discharger exposed out through said protective cap and disposed in confronting relation to said grounding member across a second spark gap.

4. An open fuse cutout according to claim 1, wherein said protective cap is in the form of a roofed cylinder, said lightning arrester element being disposed vertically along an inner side surface of said protective cap.

5. An open fuse cutout according to claim 4, wherein said charging electrode includes a discharger extending from an end of said lightning arrester element and disposed in confronting relation to said first electrode across said first spark gap, said grounding electrode including said discharger extending from an opposite end of said lightning arrester element and exposed through said protective cap, said last-mentioned discharger being disposed in confronting relation to said grounding member across a second spark gap.

6. An open fuse cutout according to claim 5, wherein said lightning arrester element is of a substantially semicylindrical shape.

7. An open fuse cutout according to claim 5, wherein said lightning arrester element is of a hollow, substantially semicylindrical shape.

* * * * *